US006176680B1

(12) United States Patent
Ringblom et al.

(10) Patent No.: US 6,176,680 B1
(45) Date of Patent: Jan. 23, 2001

(54) IMPELLER HAVING A HUB ASSEMBLED FROM A PLURALITY OF IDENTICAL PARTS

(75) Inventors: Thomas Ringblom, Bromma; Andreas Andersson, Halmstad, both of (SE)

(73) Assignee: ITT Manufacturing Enterprises, Inc., Wilmington, DE (US)

( * ) Notice: Under 35 U.S.C. 154(b), the term of this patent shall be extended for 0 days.

(21) Appl. No.: 09/328,706

(22) Filed: Jun. 9, 1999

(51) Int. Cl.[7] ..... F04D 29/34

(52) U.S. Cl. ..... 416/212 R; 416/212 A; 416/219 A; 416/220 A; 416/213 A

(58) Field of Search ..... 416/212 R, 212 A, 416/219 A, 220 A, 213 R, 213 A, 223 B

(56) References Cited

U.S. PATENT DOCUMENTS 123,274 * 1/1872 McCay ..... 416/212
335,640 * 2/1886 Simmons ..... 416/220
1,122,925 * 12/1914 Henrichsen ..... 416/212
4,930,987 * 6/1990 Stahl ..... 416/93 A
5,180,286 * 1/1993 Dean ..... 416/220 A
5,354,177 * 10/1994 Chang ..... 416/219 A

* cited by examiner

*Primary Examiner*—Edward K. Look
*Assistant Examiner*—Ninh Nguyen
(74) *Attorney, Agent, or Firm*—Menotti J. Lombardi

(57) ABSTRACT

The invention concerns an impeller or a propeller for a rotary machine such as a pump, a turbine or a propulsion unit.

The impeller comprises a hub (1) and an intermediate part put together by a number of identical hub sections (3) with mounted vanes (4). The partition between two hub sections (3) follows a curve which is substantially axially directed.

11 Claims, 1 Drawing Sheet

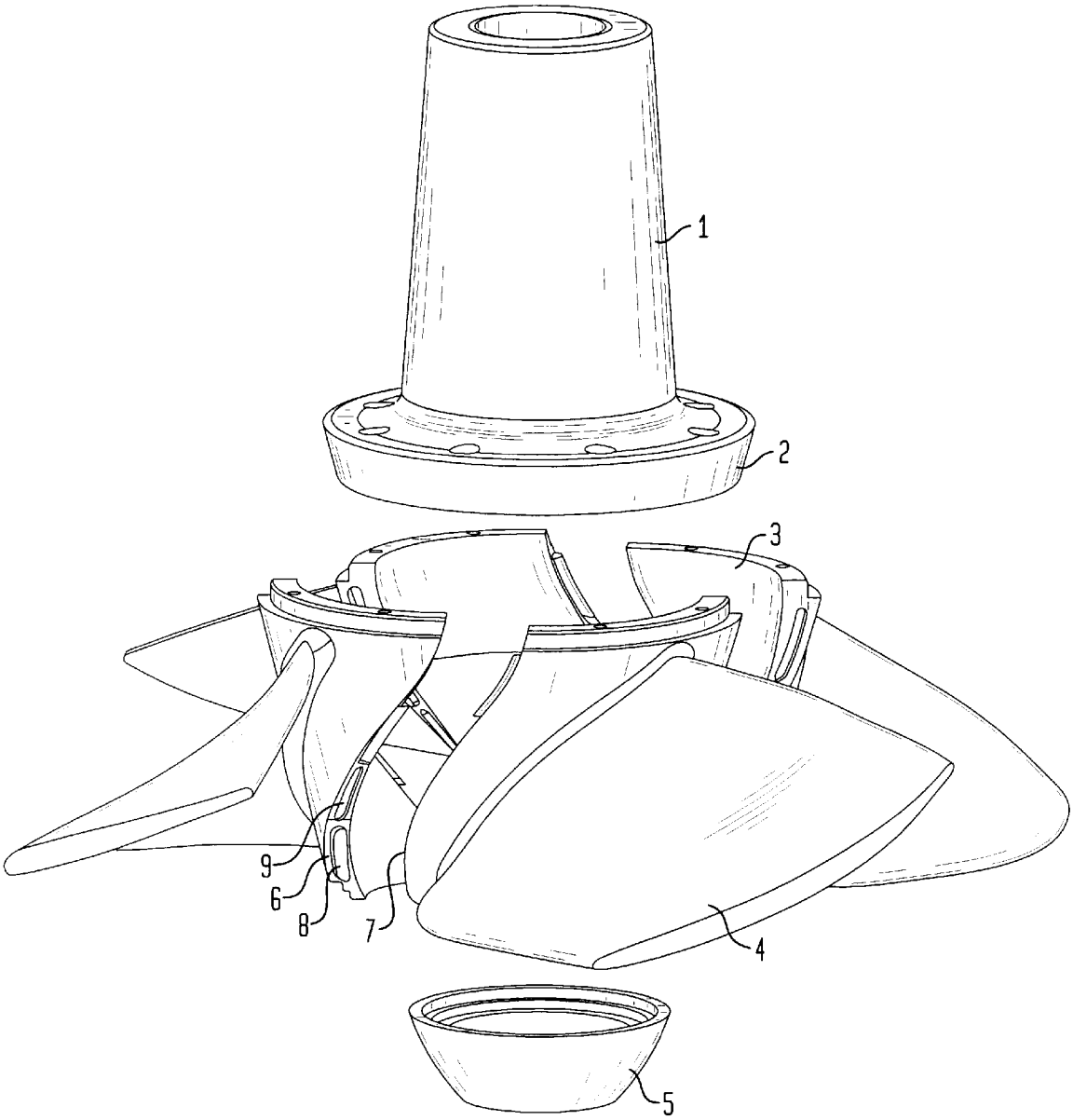
1
2
3
4
5
6
7
8
9

IMPELLER HAVING A HUB ASSEMBLED FROM A PLURALITY OF IDENTICAL PARTS

FIELD OF THE INVENTION

The invention concerns an impeller or a propeller for a rotary machine such as a liquid pump of centrifugal or axial type, a turbine or a propulsion unit.

An impeller of this type includes a hub attached to a rotary shaft and a number of vanes mounted on the hub or integrated with the latter.

In the specification below, the technique concerning axial or propeller pumps is dealt with. The invention is however applicable also for other types of impellers and propellers.

BACKGROUND OF THE INVENTION

An axial pump is characterized by the liquid being sucked into the impeller in axial direction and also leaving in axial direction. The kinetic energy obtained by the rotating impeller is transformed into pressure energy by help of a number of fixed vanes downstream of the impeller. Said vanes also normally serve as supporting elements in the pump housing.

The vanes mounted on the hub may have different designs depending on the type of liquid to be pumped, the head, etc. The angle between the hub and the vane is of great importance for the pump performance. In certain bigger machines such as turbines, it is common to make the vanes adjustable in order to obtain the best performance at different heads. This solution is of course very expensive and is also sensitive for pollutants.

By designing the hub with a spheric surface upon which the vanes are mounted, it is obtained that different vane angles may be chosen without the need to change the vane itself.

The purpose of the invention is to obtain an impeller which is easy an inexpensive to produce and possible to adapt for different types of liquids and operation conditions.

SUMMARY OF INVENTION

An impeller or a propeller for a rotary machine such as a liquid pump of centrifugal or axial type, a turbine or a propulsion unit, said impeller or propeller comprising a central part with a number of vanes attached to its periphery, the central part including a hub with a flange, an intermediate part and an end part, said intermediate part being put together by a number of identical hub sections each one provided with a vane, said sections having partitions therebetween, the partitions having substantially axially directed routes.

BRIEF DESCRIPTION OF THE DRAWING

The invention is discribed more closely below with reference to the enclosed drawing which shows an explosion view of an impeller according to the invention.

DETAILED DESCRIPTION OF THE INVENTION

In the drawing 1 stands for a hub having a flange 2. 3 stands for sections in an intermediate part, 4 vanes mounted on said sections and 5 an end part. 6 and 7 st and for opposing sectional areas in the partition between the sections 3. 8 and 9 finally stand for shoulders and notches respectively on the areas 6 and 7.

An impeller or a propeller according to the invention includes a hub 1 to be mounted on a driving shaft, not shown. The hub is provided with a flange 2 for connection to an intermediate part by any suitable means such as bolts. Said intermediate part being formed by a number of identical parts, each comprising a hub section 3 and a vane 4. The hub sections are arranged to be attached to each other, for instance by glueing, along essentially axially directed cuts and also to the flange 2 on the hub 1 and to the end part 5.

As can be understood from the above and from the drawing, the parts forming the intermediate part are identical and the partitions between them are essentially axially directed. This brings about certain manufacturing advantages.

The division of the impeller into three units along radial cuts results in further advantages. As previously mentioned, different types of vanes, different angles etc are needed in order to obtain optimum results during varying outer conditions depending on the pumped liquid, head, volume etc. The invention makes it possible to use the same parts 1 and 5 for a big variety of impellers and propellers. There is only necessary to vary the intermediate part, but as this consists of a a number of identical parts, a substantial standardization is obtained and consequently a decrease of cost.

The partition between two sections 3 is located halfway between two adjacent vanes 4 for resistance reasons. The partition cut following a curve having essentially the same route as the connection line between the vane and the hub section. The ends of the cut are however deviate and are given route mainly perpendicular to the partitions between the intermediate part and the hub and the end part respectively, thereby diminishing the shearing forces which try to dislocate the sections relative each other at certain conditions.

According to a development of the invention the opposing sectional areas 6 and 7 in each partition are provided with shoulders and corresponding notches 8 and 9 resp. By help of this means and a supplementary gluing joint, a secure mutual locking of the sections is obtained According to a further development of the invention the shoulders and notches resp. are designed with lateral surfaces which are oblique with regard to the areas 6 and 7 resp. In this way the strength is increased. By arranging two of said oblique opposing areas in a plane perpendicular to the rotary shaft of the impeller and in parallel with the planes through the connections between the intermediate part and the flange 2 and the end part 5 respectively, certain advantages concerning manufacturing are obtained.

What is claimed is:

1. A rotor for a rotary machine including a liquid pump, said rotor comprising a central part with a number of vanes attached to its periphery, the central part including a hub (1) with a flange (2), an intermediate part and an end part (5), said intermediate part being put together by a number of identical hub sections (3) with partition cuts therebetween, each section (3) provided with a vane (4), the partition cuts having substantially axially directed routes each partition cut following a curve which has substantially the same route as the connection line between a vane (4) and its hub section (3).

2. A rotor according to claim 1, wherein each partition cut between two sections (3) is located half-way between two adjacent vanes (4).

3. A rotor according to claim 2, wherein the ends of each partition cut deviate from said curve and are given a route substantially perpendicular to the partition cuts between the intermediate part and the flange (2) of the hub part (3) and the end part (5) respectively.

4. A rotor according to claim 1, wherein adjacent sections have opposing areas (6) and (7) the opposing areas (6) and (7) provided with shoulders (8) and corresponding notches (9) for securing of the sections, the shoulders and notches being designed with lateral surfaces which are oblique with regard to the opposing areas (6) and (7) and where two of said lateral surfaces are in a plane perpendicular to a rotary shaft of the rotor.

5. A rotor according to claim 1, wherein the end part includes a flanges the flange (2) of the hub part and the flange of the end part (5) encircle opposing flanges on the intermediate part.

6. A rotor according to claim 1, wherein said rotor comprises an impeller.

7. A rotor according to claim 1, wherein said rotor comprises a propeller.

8. A rotor according to claim 1, wherein said liquid pump comprises a centrifugal liquid pump.

9. A rotor according to claim 1, wherein said liquid pump comprises an axial liquid pump.

10. A rotor according to claim 1, wherein said liquid pump comprises a turbine unit.

11. A rotor according to claim 1, wherein said liquid pump comprises a propulsion unit.

* * * * *